US005927965A

United States Patent [19]

Pappas

[11] Patent Number: 5,927,965

[45] Date of Patent: Jul. 27, 1999

[54] CANDLE WITH SURROUNDING DECORATIVE COMBUSTIBLE MATERIAL

[75] Inventor: George G. Pappas, Norwich, Ohio

[73] Assignee: Lumi-Lite Candle Company, Inc., Norwich, Ohio

[21] Appl. No.: 09/099,539

[22] Filed: Jun. 18, 1998

[51] Int. Cl.[6] ..... F23D 3/16

[52] U.S. Cl. ..... 431/289; 431/288; 264/247; 264/259; 425/803

[58] Field of Search ..... 431/288, 289, 431/291, 126; 264/247, 259, 279.1; 425/803; 249/83

[56] References Cited

U.S. PATENT DOCUMENTS

| | | | |
|---|---|---|---|
| D. 111,775 | 10/1938 | Seaver . | |
| D. 173,759 | 12/1954 | Kranz . | |
| D. 178,200 | 7/1956 | McKenzie et al. . | |
| D. 370,067 | 5/1996 | Osland et al. . | |
| 2,122,451 | 7/1938 | Cassimatis . | |
| 2,817,225 | 8/1957 | Weglin . | |
| 3,175,876 | 3/1965 | Fredericks . | |
| 3,983,677 | 10/1976 | Lundbom . | |
| 4,225,552 | 9/1980 | Chang | 431/288 |
| 4,568,270 | 2/1986 | Marcus et al. | 431/288 |
| 4,696,640 | 9/1987 | Pitchford . | |
| 4,826,428 | 5/1989 | Lam | 431/289 |
| 5,395,233 | 3/1995 | Karp . | |

*Primary Examiner*—James C. Yeung
*Attorney, Agent, or Firm*—Frank H. Foster; Kremblas, Foster, Millard & Pollick

[57] ABSTRACT

A candle and method of making the candle. The candle includes a core surrounded by a combustible material and a fill composition. The combustible material surrounds the lower part of the core up to a selected level. A wick extends downwardly from the top of the core. The lower end of the wick extends no further than substantially the selected level. In this way, the risk of the combustible material catching fire is reduced.

16 Claims, 4 Drawing Sheets

CANDLE WITH SURROUNDING DECORATIVE COMBUSTIBLE MATERIAL

BACKGROUND OF THE INVENTION

1. Field of the Invention

The present invention relates generally to decorative candles and more specifically to candles which include a decorative, combustible material surrounding their lower portion.

2. Description of the Related Art

In the past, it has been desirable to decorate candles with a variety of materials to add a texture, scent, or additional decorative features. Candles have been decorated with stones, potpourri, and a variety of other particulate materials, such as cocoa powder. Other types of decorations which have been desirable have included messages on paper and the like. Many of these materials can catch fire when exposed to a flaming wick. Examples of references which disclose the desirability of including these types of materials are the patents to Cassimatis, U.S. Pat. No. 2,122,451; Weglin, U.S. Pat. No. 2,817,225; Frederics, U.S. Pat. No. 3,175,876; Lundbom, U.S. Pat. No. 3,983,677; Pitchford, U.S. Pat. No. 4,696,640; and Karp, U.S. Pat. No. 5,395,233, as well as the design patents to Seaver, U.S. Design Pat. No. 111,775; McKenzie et al., U.S. Design Pat. No. 178,200; Kranz, U.S. Design Pat. No. 173,759; and Osland et al., U.S. Design Pat. No. 370,067.

A problem which has been found when this type of material is used in a candle is that the decorative, combustible material added to the candle can come into contact with the flame when the candle is burning, thereby causing a fire. Of particular note is the problem that wax or other fuel which is used to make the candle can melt away from the combustible material, allowing the combustible material to fall into the pool of molten fuel which is near the flame. When this occurs, the combustible material can fall into or float to a position near the flame and either catch fire or become a secondary wick supporting an additional flame, which is undesirable and unsafe.

A possible, but impractical, solution to these problems would be to use candles, which include this type of material, only as decorative articles and not burn them. However, since a primary purpose of candles is to generate light, such a solution would be unacceptable to consumers.

Another possible solution is to cover the combustible material by a non-flammable shielding, such as was shown in the above-cited Pitchford disclosure. However, such a design would be unattractive in the majority of cases, as the non-flammable material would become exposed during the burning of the candle. Since candles have a decorative purpose, an unattractive candle is not a practical option.

Another option is to design the candle such that the wax does not burn to the edges, such as was shown in the above-cited patent to Karp. While this may be workable in some instances, it creates waste which is not desirable. In addition, a cylinder of wax surrounding the lit wick is not desirable and may cause the candle to burn improperly. The use of such a design can also create problems for a user who may be unable to light the candle once it burns down several inches.

Another option is to avoid combustible materials in a candle, such as was done by Lundbom. However, this solution is really not a solution at all, since it is desirable to use some combustible materials in a candle because of their aesthetic value.

What is needed, therefore, is a candle which is designed such that a combustible material can be used as a decorative feature on a candle while minimizing the probability of the combustible material becoming a secondary wick or catching fire. The present invention minimizes that risk.

BRIEF SUMMARY OF THE INVENTION

The candle of the present invention solves these and other problems by keeping the burning wick substantially above the combustible material. This candle includes a fuel core which has a top and a bottom. A combustible material surrounds a lower part of the core up to a selected level spaced from the bottom of the core. A wick is surrounded by the core and extends downwardly from the top of the core no further than substantially the selected level. The selected level may, for example, be 1 inch to about 4 inches from the bottom of the core. A fill composition, such as a candle fuel, is interspersed around the combustible material and secures the combustible material to the core. The fill composition is a fluent material when poured around the decorative combustible material, and at least partially surrounds or encases the decorative combustible material and preferably fills voids between pieces of decorative combustible material. The fill composition is not significantly fluent at normal candle operating temperatures. The fill composition may be candle wax or other candle fuel. Alternatively, it may be a non-flammable material or a flame retardant material. The fill composition and combustible material interspersion may have a width between about ¼ inch and about 2 inches.

The core may be a short-wicked candle or alternatively a candle placed on a riser. The core and the fill fuel may be wax and the combustible material may be coffee beans. The fill fuel preferably surrounds and covers the top of the core.

The method of making the candle incorporates the use of a mold. The core is placed in a mold. The mold is sufficiently larger than the core that the core is spaced from the sides of the mold. A decorative combustible material is then filled into the space until a lower part of the core is surrounded with the combustible material up to a selected level spaced from the bottom of the core. A fill composition is then poured into the space between the sides of the mold and the core to intersperse the fill composition around the combustible material.

The step of placing the core in the mold may comprise placing a short-wicked candle in the mold. Alternatively, the step of placing the core in the mold may comprise placing a riser in the mold, then placing a candle on the riser. The riser may also be poured in place.

The use of this process and product will reduce the probability of any of the combustible material falling into the pool of molten wax which forms when this type of candle is lit. The flame and the molten wax will remain separated from the combustible material. Thereby, the risk of fire when this type of candle is used is greatly reduced.

Figure 1:
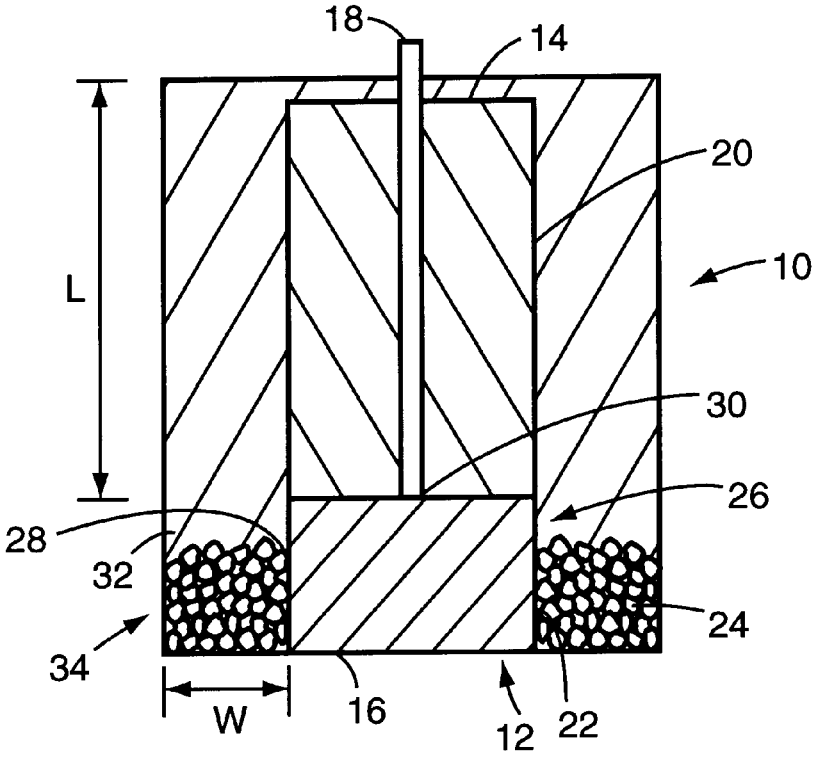
FIG. 1 is a cross-sectional view of a first embodiment of the candle of the present invention using a first embodiment of the core.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose.

DETAILED DESCRIPTION OF THE INVENTION

The present invention relates to a candle and a method of making a candle which includes a combustible material around its lower part. The product will be first described, then the method of making.

Referring most particularly to FIG. 1, the preferred embodiment of the candle 10 is shown. The candle 10 includes a cylindrical wax core 12. The core 12 includes a top 14 and a bottom 16. As is true of candles as a general matter, the top 14 is the surface of the candle 10 through which a wick 18 protrudes or extends for lighting by a user; and the bottom 16 is the surface of the candle 10 which rests on a surface (not shown) for display. The wick 18 is surrounded by the core 12 and extends downwardly from the top 14 of the core 12 towards the bottom 16 of the core 12. The shape of the candle 10 as shown in the Figs. is generally a circular cylinder. However, the shape of the candle 10 is not critical to the present invention and may be a square or oval cylinder or any other desirable shape.

The core 12 may include a number of parts. As shown in FIG. 1, the core 12 may be a candle 20 placed atop a riser 22. In the preferred embodiment, the riser 22 is a block of fuel, preferably wax. However, many alternatives to the block of fuel are possible. For example, a metal or glass block can be used in the place of the block of wax. In addition, although the riser 22 is shown in the Figs. as being the same shape and diameter as the candle 20, the riser 22 may be larger or smaller in diameter than the candle 20 or may differ in shape. It may be desirable to use a different shape for a number of reasons, including cost of production. Other possible modifications to the riser 22 will be described in connection with the method of making the candle 10 later in the present disclosure.

The core 12 is surrounded by a combustible material 24. The combustible material 24 surrounds a lower part of the core 12, up to a selected level 28. The selected level 28 is spaced from the bottom 16 of the core 12. If, as is shown in FIG. 1, the combustible material 24 is a particulate matter, the selected level 28 is more difficult to define since the precise level of the combustible material 24 is not constant, due to the particulate nature or irregular shape of the material not allowing each particle to fall to the same height. However, the selected level 28 is defined as generally the point at which the uppermost particles of the combustible material 24 touch the core 12.

The wick 18 extends downwardly from the top 14 of the core 12 no further than substantially the selected level 28. The terms "down" and "low" and their related forms refer to a direction towards the bottom 16 of the core 12, while the terms "up" and "high" and their related forms refer to a direction towards the top 14 of the core 12. It is preferable for no part of the wick 18 to be lower than any particle of the combustible material 24. However, even if there is some overlap of the combustible material 24 and the wick 18, the product will still operate in accordance with and have the advantages of the invention. A small amount of overlap is permitted, in part because the liquid pool of fuel which forms when the candle burns is somewhat bowl-shaped and thus a particle of combustible material 24 which is slightly higher than a portion of the wick 18 will still not fall into the liquid pool of fuel. Thus, the wick 18 must extend downwardly no further than substantially the selected level.

Figure 3:
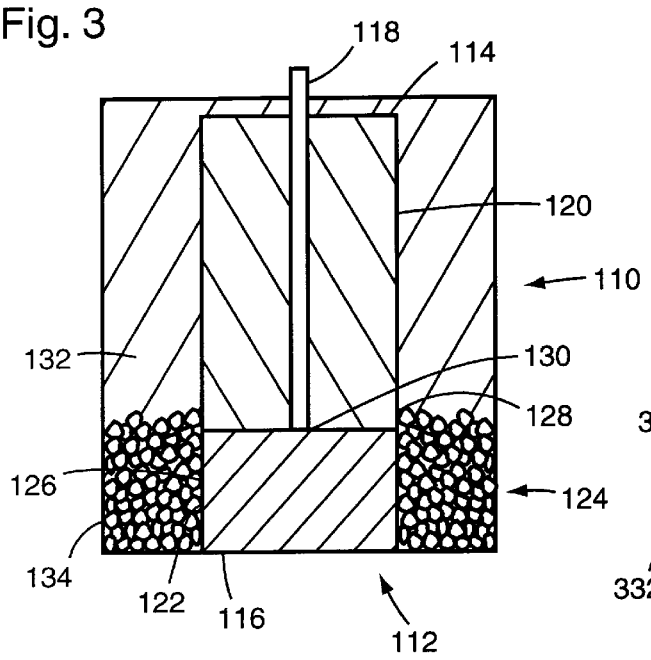
FIG. 3 is a cross-sectional view of a second embodiment of the candle of the present invention.

The lower end 30 of the wick 18 may take a variety of positions with respect to the selected level 28 and the combustible material. As shown in FIG. 1, the lower end 30 of the wick 18 terminates above the selected level 28. The length L of the wick 18 may be even smaller and the lower end 30 of the wick 18 may be even further above the selected level 28. Alternatively, in a second embodiment of the candle 110, shown most clearly in FIG. 3, the lower end 130 of the wick 118 terminates substantially at the selected level 128. In all other ways, the second embodiment of the candle 110 is identical to the first embodiment of the candle 10. FIG. 3 shows that terminating substantially at the selected level 128 includes terminating slightly lower than the selected level 128.

Figure 2:
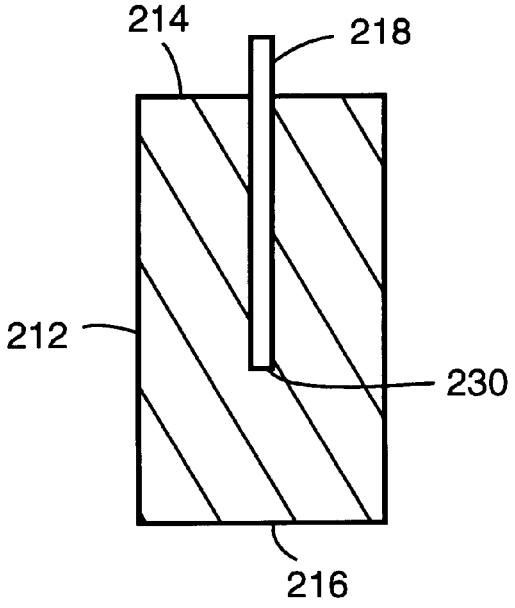
FIG. 2 is a cross-sectional view of a second embodiment of the core of the present invention.

Turning now to FIG. 2, an alternative embodiment of the core is shown. FIG. 2 shows a short-wicked candle 212. A short-wicked candle, generally speaking, is a candle formed by placing a wick only part of the way down the candle. The wick 218 extends from the top 214 of the core 212 towards the bottom 216 of the core 212 but does not reach the bottom 212 of the core 216. Thus, in this embodiment of the core 212, the candle 20 and riser 22 of the first embodiment of the core 12 are formed in one piece. Either of the embodiments of the core 12, 212 and the various possible modifications may be used in any of the later Figs. However, the first embodiment of the core 12 is used throughout the remaining Figs.

Returning to FIG. 1, the candle 10 also includes a fill composition 32. The fill composition 32 is interspersed around the combustible material 24 and secures the combustible material 24 to the core 12. The fill composition 32 can only be truly interspersed around the combustible material 24 if the combustible material 24 is a particulate matter, as is shown in the Figs. However, the combustible material 24 can be a number of types of materials including a solid ring of paper or the like. In such a case, the term "interspersed around" means at least partially surrounding, as a primary purpose of interspersing the fill composition 32 and combustible material 24 is to secure the combustible material 24 to the core 12. Another primary purpose of interspersing the fill composition 32 around the combustible material 24 is to secure the particles of the combustible material 24 to each other. The fill composition 32 may surround more than the lower part 30 of the core 12 and may surround the core 12 and cover the top 14 of the core 12.

There are a variety of preferred materials and preferred spacing arrangements in the present invention. The core 12 and the fill composition 32 are preferably made of fuels which are solid at room temperature, but which melt when the wick 18 is lit. The core 12 and fill composition 32 are preferably made of the same fuel, most preferably wax. The combustible material 24 is preferably a particulate matter, such as potpourri, candy, leaves, or the like. Most preferably, the combustible material 24 is coffee beans or cinnamon strips. The selected level 28 is preferably spaced from the bottom 16 of the core 12 by between about 1 inch and about 4 inches. The mixture formed when the fill composition 32 is interspersed around the combustible material 24 is referred to as the fill composition and combustible material interspersion 34. The fill composition and combustible material interspersion 34 preferably has a width W between about ¼ inch and about 2 inches.

Figure 4:
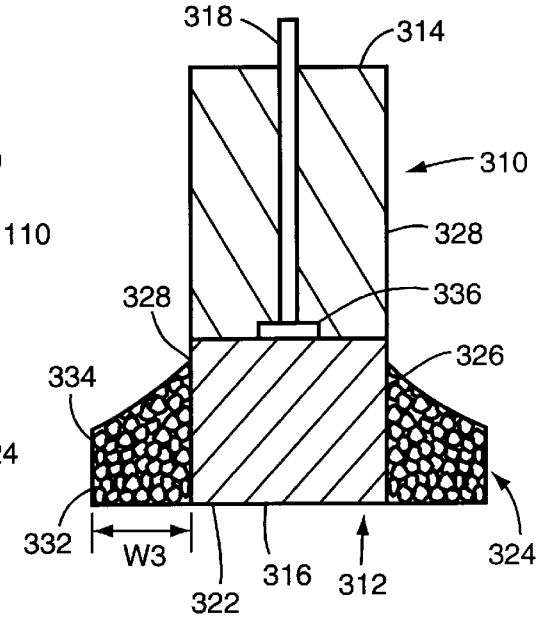
FIG. 4 is a cross-sectional view of a fourth embodiment of the candle of the present invention.
Figure 5:
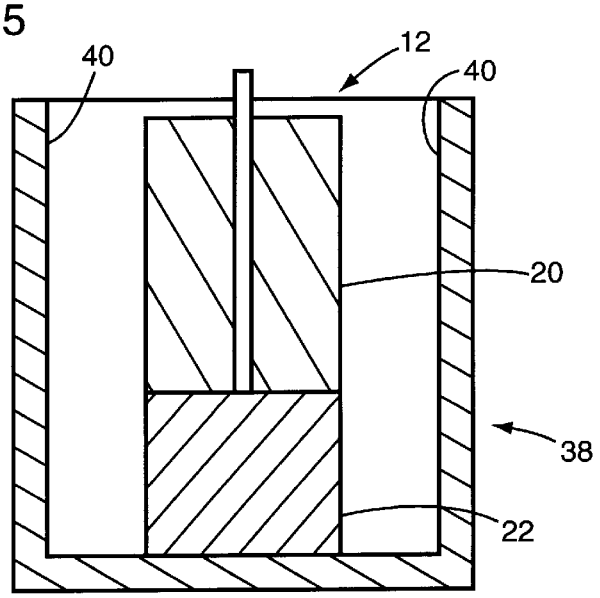
FIG. 5 is a cross-sectional view of a core in a mold.

A variety of other possible modifications to portions of the present invention are shown in FIG. 4. Any of these modifications can be made individually to any of the embodiments mentioned above. As shown in FIG. 4, the fill composition 332 may surround only a portion of the core 312 to form a protruding base. If the width W3 of the fill composition and combustible material interspersion 334 is small enough, the difference may not be noticeable.

There may also be included a wick sustainer 336 to be used as a base for retaining the wick. The wick sustainer 336 can also operate to separate the wick 318 from the riser 322. A sheet of non-flammable material, such as an aluminum foil, can also be interposed between the wick and the riser 322 to provide a barrier separating the riser portion of the core from the candle portion of the core. The wick sustainer 336 may be a non-flammable material, and its base may extend radially outwardly to serve as the barrier.

The method of making the candle 10 is shown in FIGS. 5–9. As most clearly seen in FIG. 5, the core 12 is placed in the mold 38. The core 12 is spaced from the sides 40 of the mold 38, as is most clearly shown in FIG. 9. Since the mold 38 is shown as being a circular cylinder, there is only one, surrounding side 40. Thus, the term "sides 40" includes the singular as well as the plural. The step of placing the core 12 in the mold 38 may include a number of steps. The placing step may include placing a riser 22 in the mold 38, then placing a candle 20 on the riser 22. Alternatively, the placing step may include placing a short-wicked candle 212 in the mold 38.

Figure 6:
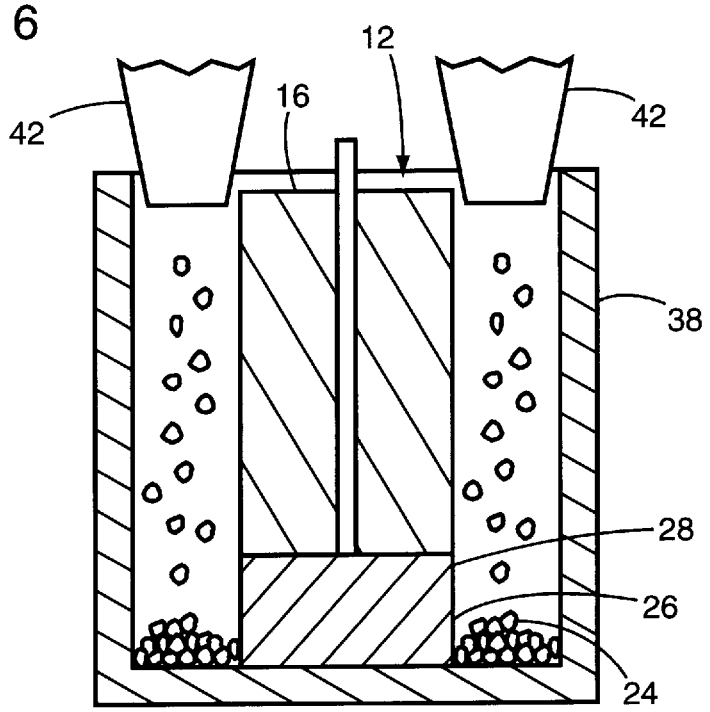
FIG. 6 is a cross-sectional view of a core in a mold being surrounded by a combustible material.

Next, the lower part 26 of the core 12 is surrounded with a combustible material 24 up to a selected level 28. As stated earlier in the disclosure, the wick 18 is surrounded by the core 12 and extends downwardly from the top 16 of the core 12 no further than substantially the selected level 28. As shown in FIG. 6, the combustible material 24 may be introduced into the mold 38 through a spout 42. The spout 42 is representative of any of the ways known in the art, such as a funnel, for introducing the combustible material 24 into the mold 38 to surround the core 12. Any of the ways known in the art are acceptable and a person of ordinary skill in the art can easily select the most appropriate method or apparatus for this step based on the particular particle size of the combustible material 24.

Figure 7:
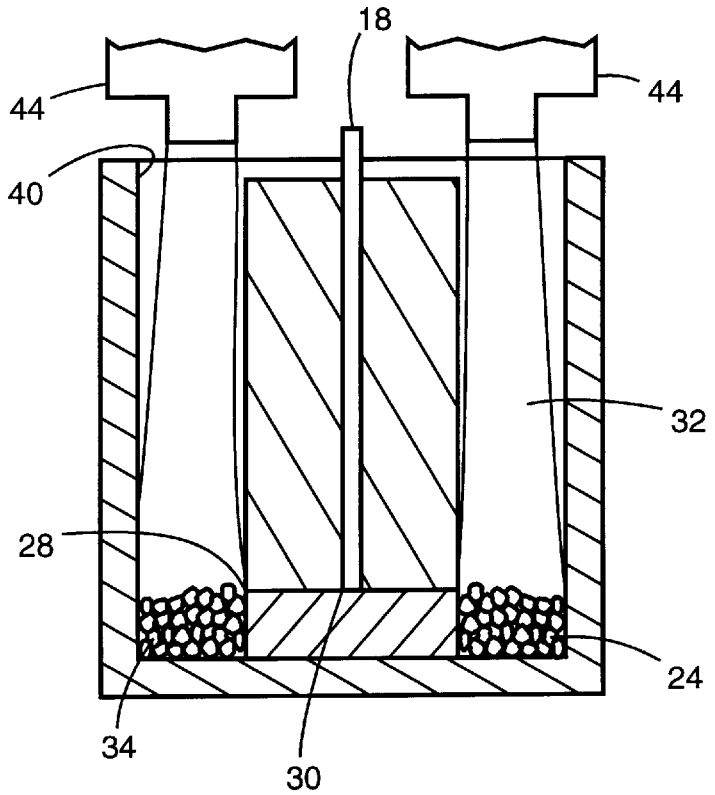
FIG. 7 is a cross-sectional view of a core in a mold, the fill fuel being interspersed with the combustible material which surrounds the core.

As seen in FIG. 7, a fill composition 32 is poured into the mold 38 between the sides 40 of the mold 38 and the core 12. The fill composition 32 intersperses around the combustible material 24 and forms a wall surrounding the core. FIG. 7 shows the fill composition 32 as being introduced into the mold 38 through spouts 44. The spouts 44 are representative of any of the ways known in the art for introducing the fill composition 32 into the mold 38 to surround at least the lower part 26 of the core 12. Any of the ways known in the art is acceptable and a person of ordinary skill in the art can easily select the most appropriate method or apparatus for this step based on the particular properties of the fill composition 32, such as melt temperature, viscosity, and the like. The term "pour" is used for the introduction of the fill composition 32 into the mold 38 because ordinarily, the fill composition 32 will be introduced into the mold in a liquid form. The term pour is intended to encompass any method of introducing a fill composition 32 into the mold in a liquid or other fluent form. It is important that the fill composition 32 be fluent because otherwise, the fill composition 32 will not intersperse around the combustible material 24. The fill composition and combustible material interspersion 34 can be separately formed and inserted into the mold 38 to surround the core 12.

The pouring step may alternatively include introducing the fill composition 32 in pellet form into the mold 38 to surround the core 12. If a pellet form is used, then the mold 38 must be heated in order to melt the fluent pellets of fill composition 32 prior to removing the candle 10 from the mold 38, or the pellets of fill composition 32 and the combustible material 24 would not remain attached to the core 12. If the pellet form of the fill composition 32 is desired and it is not possible or preferred by a maker to heat the mold 38, a container (not shown) may be inserted in the mold to retain the core 12, the combustible material 24, and the pellets of fill composition 32 in relative position to form a container candle. This configuration is not preferred.

Figure 8:
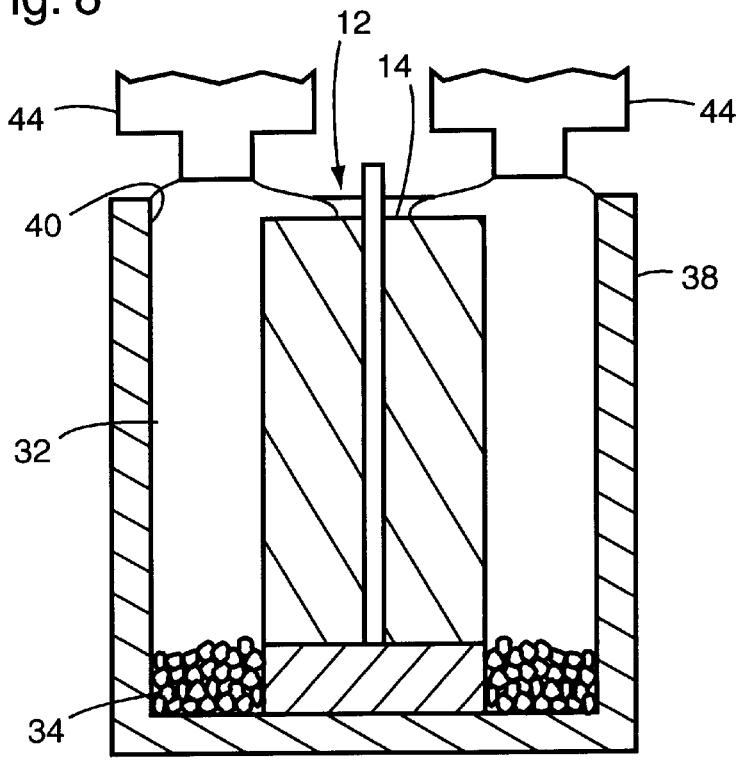
FIG. 8 is a cross-sectional view of a core in a mold, the fill fuel being poured to cover the top of the core.
Figure 9:
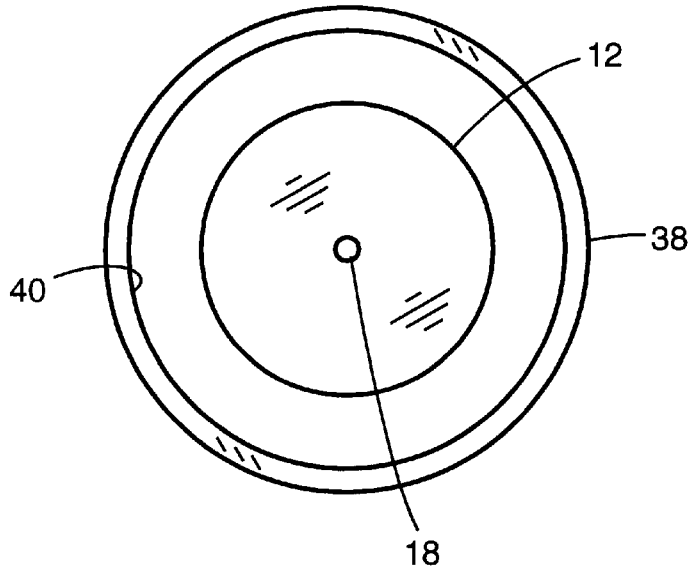
FIG. 9 is a top view of the core in the mold as shown in FIG. 5.

There is no restriction as to the height to which the fill composition 32 may be poured, except that it should not be poured to overflow the mold 38 or submerge the wick 18. The fill composition 32 may be poured so that it surrounds the core 12 and covers the top 14 of the core 12 to provide a uniform outer surface, as is best shown in FIG. 8.

There are alternative systems for the placing of a riser 22 in the mold 38, as mentioned in connection with the description of the candle 10. Instead of placing a riser 22 in the mold 38 and then placing a candle 20 atop the riser 22, the combustible material 24 and the fill composition 32 may be poured into the mold 38 only up to a selected level 28 to form a cylindrical disk extending between the sides 40 of the mold 38. A candle 20 may then be placed on the solidified fill composition and combustible material interspersion 34. Alternatively, the candle 20 can be suspended by its wick 18 in the mold 38 and the combustible material can be poured into the mold to fill the area under the suspended candle 20. Additional fill composition 32 can then be poured around the candle 20 or around and under the candle 20, depending on the precise method used. In such a case, the creation of the layer of fill composition and combustible material interspersion 34 under the candle 20 has a result which is equivalent to the result of the step of placing a riser 22 in the mold 38. Placing the candle 20 on the interspersion 34 has a result which is equivalent to the result of placing the candle 20 on a riser 22. In such an instance, the layer of interspersion 34 would be equivalent to the combustible material 24 surrounding the core 12 and the fill composition 32 being interspersed with the combustible material 24 and securing the combustible material 24 to the core 12.

While certain preferred embodiments of the present invention have been disclosed in detail, it is to be understood that various modifications may be adopted without departing from the spirit of the invention or scope of the following claims.

I claim:

1. A candle, comprising:

(a) a fuel core having a top and a bottom;

(b) a combustible material surrounding a lower part of the core up to a selected level spaced from the bottom of the core;

(c) a wick surrounded by the core and extending downwardly from the top of the core no further than substantially said selected level; and (d) a fill composition interspersed around the combustible material, surrounding at least a portion of the fuel core and securing the combustible material to the core.

2. The candle according to claim 1, wherein the core comprises a short-wicked candle.

3. The candle according to claim 1, wherein the core comprises a candle being placed on a riser.

4. The candle according to claim 1, wherein the core and the fill composition are wax.

5. The candle according to claim 1, wherein the combustible material is coffee beans.

6. The candle according to claim 1, wherein the fill composition and combustible material interspersion has a width between about ¼ inch and about 2 inches.

7. The candle according to claim 1, wherein the selected level is spaced from the bottom of the core between about 1 inch and about 4 inches.

8. The candle according to claim 1, wherein the fill composition surrounds the core and covers the top of the core.

9. The candle according to claim 1, wherein the wick includes a lower end which extends into the core and terminates substantially at the selected level.

10. The candle according to claim 1, wherein the wick includes a lower end which extends into the core and terminates above the selected level.

11. A method of making a candle, comprising:

(a) placing a core in a mold, the mold being sufficiently larger than the core that the core is spaced from sides of the mold, the core having a top and a bottom;

(b) surrounding a lower part of the core with a combustible material up to a selected level spaced from the bottom of the core, a wick surrounded by the core extending downwardly from the top of the core no further than substantially said selected level; and (c) pouring a fill composition into the mold between the sides of the mold and the core to intersperse the fill fuel around the combustible material.

12. The method of making a candle according to claim 11, wherein the step of placing the core in the mold comprises placing a short-wicked candle in the mold.

13. The method of making a candle according to claim 11, wherein the step of placing the core in the mold comprises placing a riser in the mold and placing a candle on the riser.

14. The method of making a candle according to claim 11, further comprising pouring the fill composition into the mold to surround the core and cover the top of the core.

15. The method of claim 11 wherein a non-flammable fill composition is poured into the mold.

16. The method of claim 11 wherein a flame retardant fill composition is poured into the mold.

* * * * *